US006481926B2

(12) United States Patent
Benedict et al.

(10) Patent No.: US 6,481,926 B2
(45) **Date of Patent: *Nov. 19, 2002**

(54) ADJUSTABLE POROUS STRUCTURES AND METHOD FOR SHORELINE AND LAND MASS RECLAMATION

(75) Inventors: Charles E. Benedict; James R. Dobbs; A. Yates Christian; Perry L. Ponder, all of Tallahassee, FL (US)

(73) Assignee: Beach Reclamation, Inc., Tallahassee, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/828,241

(22) Filed: Apr. 9, 2001

(65) Prior Publication Data

US 2002/0021940 A1 Feb. 21, 2002

Related U.S. Application Data

(63) Continuation-in-part of application No. 09/385,360, filed on Aug. 30, 1999, now abandoned, which is a continuation-in-part of application No. 09/027,549, filed on Feb. 23, 1998, now Pat. No. 5,944,443, which is a continuation-in-part of application No. 08/582,253, filed on Jan. 3, 1996, now Pat. No. 5,720,573.

(51) Int. Cl.[7] ..... E02B 3/04

(52) U.S. Cl. ..... 405/21; 405/15; 405/32; 405/34; 405/302.7; 256/12.5

(58) Field of Search ..... 405/15–17, 34, 405/35, 32, 21–33, 302.7; 256/12.5

(56) References Cited

U.S. PATENT DOCUMENTS 2,341,515 A 2/1944 Rehfeld
4,089,179 A * 5/1978 Trautman ..... 256/12.5
4,279,535 A 7/1981 Gagliardi et al.
4,749,306 A 6/1988 Demeny et al.
4,756,511 A 7/1988 Wright
5,029,819 A 7/1991 Kane
5,108,222 A 4/1992 Jansson et al.
5,108,224 A 4/1992 Cabaniss et al.
5,255,997 A * 10/1993 Bailey et al. ..... 405/15
5,348,419 A * 9/1994 Bailey et al. ..... 405/15
5,720,573 A 2/1998 Benedict et al.
5,758,868 A * 6/1998 Shea ..... 256/12.5
5,944,443 A 8/1999 Benedict

FOREIGN PATENT DOCUMENTS

IT 565640 8/1957

OTHER PUBLICATIONS

Tensar Earth Technologies, Inc., advertising brochure, 14 pgs. (Undated).

* cited by examiner

*Primary Examiner*—Heather Shackelford
*Assistant Examiner*—Frederick L. Lagman
(74) *Attorney, Agent, or Firm*—Dowell & Dowell, P.C.

(57) ABSTRACT

A method and apparatus for land reclamation which includes utilizing groyne-like structures including spaced stanchions to which are mounted porous screens and wherein the screens are vertically adjustable as material is deposited during the reclamation process. In some embodiments the screens are carried by sleeves slidable on spaced stanchions and in other embodiments the screens may be sectional and carried by multiple sleeves.

23 Claims, 7 Drawing Sheets

11
14
11A
D
F
10

30
11
D
F
14
10

11
30
F
14
10

ADJUSTABLE POROUS STRUCTURES AND METHOD FOR SHORELINE AND LAND MASS RECLAMATION

CROSS REFERENCES TO RELATED APPLICATIONS

This application is a continuation-in-part of U.S. application Ser. No. 09/385,360 filed Aug. 30, 1999, now abandoned which was a continuation-in-part of U.S. application Ser. No. 08/582,253 filed Jan. 3, 1996 and entitled ADJUSTABLE POROUS GROYNES AND METHOD FOR SHORELINE RECLAMATION and assigned to the Assignee of the present application which issued as U.S. Pat. No. 5,720,573 on Feb. 24, 1998 and continuation-in-part of U.S. application Ser. No. 09/027,549 filed Feb. 23, 1998 and entitled POROUS GROYNES AND METHOD FOR SHORELINE RECLAMATION and assigned to the Assignee of the present application which issued as U.S. Pat. No. 5,944,443 on Aug. 31, 1999.

BACKGROUND OF THE INVENTION

1. Field of the Invention

The present invention is directed to porous groyne-like or porous screen structures and method for their use in reclaiming beaches, shoreline areas and other land masses which are subject to erosion by natural forces and, more specifically, to porous screen structures which are vertically adjustable during use, thereby allowing the screens to be systematically raised as reclamation progresses from the buildup of silt, sand, shells, dirt, twigs and branches, grasses and other materials.

2. Discussion of the Related Art

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion in many areas, large seawalls are constructed to prevent high tides from reaching land and property. Such structures are costly and are only practical when population densities make it economically reasonable to construct them. Further, such structures have an adverse effect on the natural appearance of the shoreline and, in many areas, cannot be practically constructed.

Other methods of shoreline reclamation include creating jetties or artificial barriers or reefs which extend from the shoreline. These structures are permanent installations and are generally utilized to prevent sand along coastal areas from washing out to sea by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated.

A further method for reclaiming shoreline areas and preventing erosion is the placement of off-shore, underwater barriers. Often, large porous structures are placed along a sea floor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand importation. When major dunes along a shoreline are damaged or washed away during heavy storms, it is often necessary to import new dirt and sand to re-establish the dunes to provide a natural barrier to tidal activity. Dredgers are commonly utilized to pump sand from a sea floor or riverbed to build up natural barriers. Such methods of shoreline reclamation, however, are temporary measures, at best, and do not provide a long-term solution to shoreline erosion. Further, such restoration methods are extremely costly and are not practical in many locations.

In view of the foregoing, there is a need to provide a method and apparatus for economically reclaiming damaged shorelines, and other land mass beach areas which can be practically used without an adverse effect to either land or water environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly collected material, are withdrawn by winches or other means. The removal of the netting material can adversely affect the restored shoreline by creating trenches or furrows which form natural channels in which water flows away from the shoreline thereby conveying particulate matter back to a body of water.

Other examples of porous shoreline reclamation structures are disclosed in U.S. Pat. No. 227,483 to Case, U.S. Pat. No. 1,060,357 to Nies, U.S. Pat. No. 1,948,639 to Youngberg, U.S. Pat. No. 1,646,168 to Pringle, U.S. Pat. Nos. 2,097,342 and 2,341,515 to Reheld, U.S. Pat. No. 2,135,337 to Herbert, Jr., U.S. Pat. No. 2,662,378 to Schmitt, et al., U.S. Pat. No. 3,564,853 to Csiszar, U.S. Pat. No. 4,861,193 to Newkirk, U.S. Pat. No. 4,118,937 to Mansen, U.S. Pat. No. 4,738,563 to Clark, U.S. Pat. No. 5,108,222 to Jansson, et al., and U.S. Pat. No. 5,255,997 to Bailey, et al.

SUMMARY OF THE INVENTION

The present invention is directed to a method and apparatus for reclaiming shoreline, beach and offshore areas which includes the installation of removable groyne-like structures having a plurality of posts or stanchions which are embedded in a sea floor, or in other areas, so as to extend in spaced relationship outwardly from a shoreline and between which are mounted one or a plurality of porous screens. As used herein, the term shoreline refers to both land and offshore bottom areas including beaches and banks situated along lakes, rivers, inlets, bays, seas, oceans and the like, it being the express purpose of the present invention to build up solid material deposits both on and offshore. The screens may be formed of any suitable materials having a plurality of openings therein and, in preferred embodiments, are formed of flexible elements such as chain link, conventional netting, geo-textiles, expanded plastics, nylon meshes, knitted and woven fabrics and the like. In some embodiments, the openings may be created in somewhat non-flexible materials such as open slatted wooden or plastic structures.

The screens are supported relative to the stanchions and have lower edges which are designed to rest on and become temporarily embedded in deposited material forming a new land mass. The screens further include means for periodically and systematically elevating at least the lower portion thereof to thereby prevent the screens from being too deeply embedded within newly deposited particulate material. Such means may include tie lines, take-up reels, hoists and the like which are used to elevate the screens by either manual or motor operated devices. Hoist or winch devices may be mounted at a common point for each structure or may be separately attached to spaced stanchions along a structure.

To facilitate the manner in which the screens are periodically raised, in one embodiment, each screen is secured at its opposite ends to rings or loop members which encircle and are vertically adjustably moveable along at least a pair of spaced stanchions which support each screen. Thus, when screens are extended or deployed in generally end-to-end relationship, each end is secured to a separate stanchion. In some embodiments the ends of the screens may partially overlap one another. With some of the groyne structures of the invention, many of the stanchions will be deployed in pairs extending in spaced relationship to one another such that one screen may be vertically adjusted without effecting the placement of adjacent screens. In other embodiments, screens may extend between three or more stanchions with the ends of the screens secured to common stanchions.

To further facilitate the manner in which the screens of the invention are vertically adjusted and to strengthen the integrity of the groynes of the invention, each screen may be secured at its opposite ends to one or more tubes or sleeves which are slidable disposed about the spaced stanchions. Elevation of the screens may be accomplished by lifting or elevating the sleeves relative to the stanchions. In preferred embodiments, each screen is secured at its ends to stanchions not supporting other screens, however, in some embodiments the sleeves may support adjacent screens in end-to-end relationship.

To rigidify the screens when flexible materials are used, cables, wire rope or similar elements are provided at least along the upper, lower and end edges or selvages of each screen or screen sections. The longitudinal cables are secured to the vertically extending end cables so that, by clamping the vertical cables to the stanchions, tension is applied to the longitudinal cables to thereby pull the cables, and thus the screen material, taut between the stanchions.

As a further improvement, in some embodiments, each screen may be sub-divided into separate vertical sections, each of which may be secured to a plurality of separate sleeves movably mounted on end supporting stanchions. In this manner, as the screen sections are raised, the uppermost sections can be removed from the groyne structures, as is necessary.

The screens of the present invention may include non-uniform mesh openings between the lower and upper portions thereof. In some embodiments, a plurality of screen sections are vertically joined with respect to one another with the lower screen sections having mesh openings of a smaller dimension than each subsequent vertical section. In other embodiments, the screen sections are not joined and are independently supported and moved. Typical openings may range from approximately ⅛" in the lowermost screen sections to 1" or more in uppermost screen sections. In one embodiment, four screen sections are disclosed, although the number of screen sections may be varied depending upon the requirements of a particular reclamation site.

The screen sections are elevated utilizing lifting ropes or lines which are secured such as along the lower edges of the sections and/or at spaced elevated locations along the screens, such as at the intersection of the various vertical sections of a screen. Alternatively, or in addition to, the screen sections may be elevated by lifting rings or sleeves which connect the screens to the stanchions.

Utilizing the methodology of the present invention, a plurality of spaced groyne structures are positioned so as to extend outwardly from a shoreline in spaced relationship with respect to one another. The orientation between the groyne structures and their angular relationship with respect to other areas or masses, such as along a shoreline, will be dictated by the specifics of a given area including currents, tidal activity and winds. Once the screen or screens have been secured to the spaced stanchions, the lower portions of the screens are periodically elevated, as deposits form at the base of the screen sections, so as to not become too deeply embedded in the newly deposited material.

Preferably, the lower portions or lower edges of the screens are elevated such that a portion of the lower edges are retained within material deposited, so that the material deposited retains the lower edges of the screens on the land mass or sea floor. The structures of the present invention further facilitate the raising of the screens and securing of the screens in a raised position during periods when it is necessary, for example, so as not to interfere with movement of aquatic or other life. Following reclamation, the structures may be easily removed without disturbing the contour of the reclaimed land.

It is a primary object of the present invention to provide a method and apparatus for economically reclaiming land including along shorelines and offshore areas of oceans, gulfs, inlets, bays, rivers, lakes as well as other areas where currents, tidal and/or wind activity is experienced.

It is a further object of the present invention to provide groyne structures and a method for installing such structures in such a manner that the structures may be temporarily installed and removed after land has been reclaimed without disturbing the natural contour of the reclaimed land.

It is yet a further object of the present invention to provide groyne structures which may be utilized to reclaim land, such as along a shoreline, which are environmentally compatible and which may be periodically adjusted so as to not adversely affect the buildup of deposited materials.

It is also an object of the present invention to provide groyne structures which may be utilized to reclaim land, such as along a shoreline, which, in some embodiments, include screens which may be individually adjusted, be formed of independently moveable sections and/or be constructed of materials having sections of different porosity or opening sizes such that the smaller openings in the screen are provided along lower sections thereof to facilitate buildup of fine particles along the base of the screens.

It is another object of the present invention to provide a method and apparatus for economically reclaiming land including along shorelines and offshore areas of oceans, gulfs, inlets, bays, rivers and the like wherein the buildup of material deposits is utilized to temporarily retain the lower portions of the screens in position.

BRIEF DESCRIPTION OF THE DRAWINGS

The present invention will be best understood with reference to the accompanying drawing figures, wherein.

DESCRIPTION OF THE PREFERRED EMBODIMENTS

Figure 1:
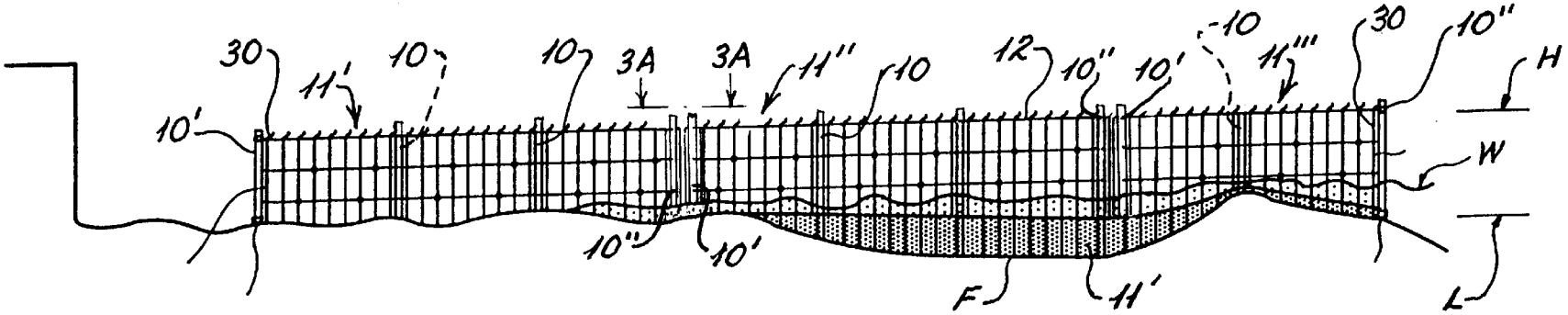
FIG. 1 is a side elevational illustrational view of one embodiment of the invention showing the deployment of stanchions, some in pairs, and screens, relative to a shoreline and extending outwardly therefrom.

With continued reference to the drawing figures, the porous groyne systems of the present invention will be described in greater detail. Each porous groyne system is specifically configured to capture rocks, shells, sand and other material and deposit them such as along a beach or offshore in order to reclaim land and/or beach frontage in such a manner that reclaimed materials are not adversely disturbed by the use of the system. With specific reference to FIG. 1, the groyne structures are designed to extend outwardly at an angle with respect to a line of material flow as exemplified along a beach generally from a high tide line "H" to a low tide line "L" or beyond into the water. In beach areas, the groyne structures may be deployed generally perpendicularly from the beach outwardly into a body of water; in some areas, it may be necessary to incline the direction of the structures at an angle between the shore and the water. In most cases, the structures are designed to be installed so that they extend above the maximum high tide line "H".

The groyne structures include a plurality of spaced posts or stanchions 10 which may be formed of any sufficiently durable and environmentally compatible supporting material. In some embodiments, galvanized pipe will be utilized because of cost, strength and durability. The stanchions are embedded into land such as along a beach or the sea floor a sufficient distance to support one or a plurality of screens such as shown at 11', 11" and 11"'. The number of screens may vary. Screen 11' extends from an inner end stanchion 10', in front of a second intermediate stanchion 10, behind a third intermediate stanchion 10 and is secured at its outer end or edge to a first outer end stanchion 10". Screen 11" extends from the next inner end stanchion 10', which is adjacent the first outer end stanchion 10", and about opposite sides of the next two intermediate stanchions 10 and is secured to the next outer end stanchion 10". Screen 11"' extends from the next inner end stanchion 10' along one side of stanchion 10 to an outer end attached to outermost end stanchion 10". Although screens 11' and 11" are shown associated with four stanchions or posts and screen 11"' is associated with three stanchions, each screen may be associated with two or more stanchions. In some embodiments, only one inner and one outer stanchions may be provided with one or more intermediate stanchions and, the screen may be continuous in length from between the inner and outer stanchions.

Figure 2:
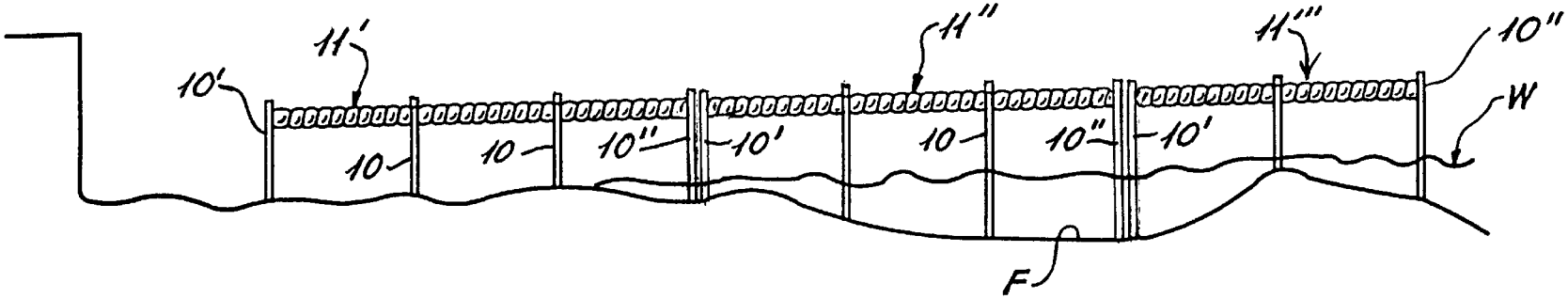
FIG. 2 is a view similar to FIG. 1 except showing the screens raised so as to not obstruct natural movement of aquatic life.

With the groyne structure disclosed in FIGS. 1 and 2, each screen 11', 11" and 11"' may be independently vertically adjusted or raised in keeping with the teachings of the invention. This permits the screens to be raised as necessary depending upon material build-up adjacent each screen. Also, should a screen become damaged, it can be easily replaced without effecting adjacent screens.

Figure 3A:
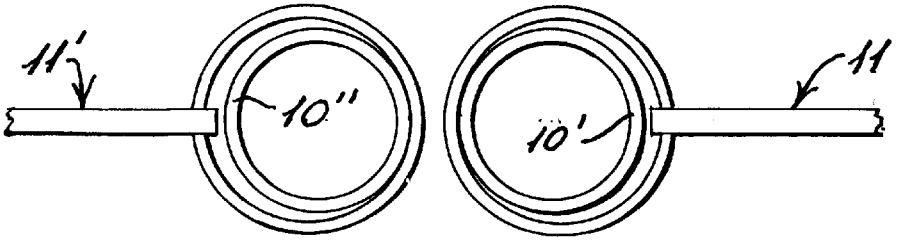
FIG. 3A is an enlarged partial top plan view of two adjacent stanchions of the invention taken along line 3A—3A of FIG. 1 showing rings for securing screens relative thereto in accordance with the teachings of the invention.
Figure 3B:
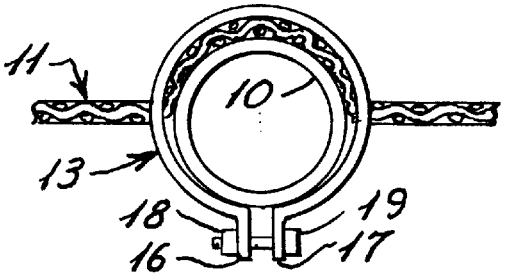
FIG. 3B is a top plan view of a clamp for securing screens to some stanchions of the invention.

The stanchions or posts will be spaced at approximately 10 to 20 foot intervals, however, the spacing may vary. Further, although the screens are shown as being aligned in FIG. 1, it is possible that the screens may be staggered or off-set with respect to one another such that the stanchions 10' are placed along side of, or closer to shore than the stanchions 10". Further, as shown in FIG. 3B, a clamp 13 may be clamped adjacent the top of the intermediate stanchions 10 for purposes of securing the screens or mesh materials to such intermediate stanchions. Lifting lines, which may include cables, may be placed at each stanchion and/or at intermediate positions between the stanchions as required for lifting the bottom, intermediate or entire portions of the screens as necessary as the reclamation process proceeds, as will be described hereinbelow.

The porous mesh of the screens 11', 11" and 11"' may be formed of substantially any suitable materials having a plurality of openings therein. It is preferred that the openings be varied or non-uniform throughout the structure of the screen material and that the openings near the lower edge 14 of each screen be smaller than openings at the intermediate and upper portions thereof. In this respect, openings of ⅛" or less are contemplated adjacent the lower edge 14 of each screen, with openings varying to as much as one or more inches at the upper portion. The upper 12, lower 14 and side or end edges 15 of each screen may be formed with a conventional selvage material if the screen is formed of fabric and may be reinforced by one or more longitudinal cables 48 and end cables or wire ropes 49, see FIG. 5. Preferably, the cables 48 extend at least along the upper and lower edges of each screen and within the selvage material. The ends of the longitudinal cables are secured to the vertical cables 49 provided at least at each end of each screen. In this manner, when the screens are secured relative to the end stanchions, the end cables are clamped to the stanchions thereby placing tension on the longitudinally extending upper and lower cables to pull them taut so as to restrain the screens from sagging and moving laterally relative to the line of the groyne structure. Also, the lower taut cables will resist elevation of the lower portions of the screens by tidal, current, wave or wind action.

In some embodiments, the opposite ends 15 of each screen may include grommets 16 or other reinforced areas or openings for purposes of mounting the ends to rings 22 or sleeves which are vertically movably mounted about each of the stanchions 10' and 10", as shown in FIGS. 3, 5 and 9–11. The number of rings or sleeves and the manner in which each screen is secured to the rings or sleeves may vary. Further, it is contemplated that other vertically adjustable mechanical supports may be used to connect the screens to the stanchions 10' and 10". As noted, the screens are preferably attached by clips, clamps or the like or otherwise securing at least the cable reinforced ends thereof to the rings or sleeves.

Figure 4:
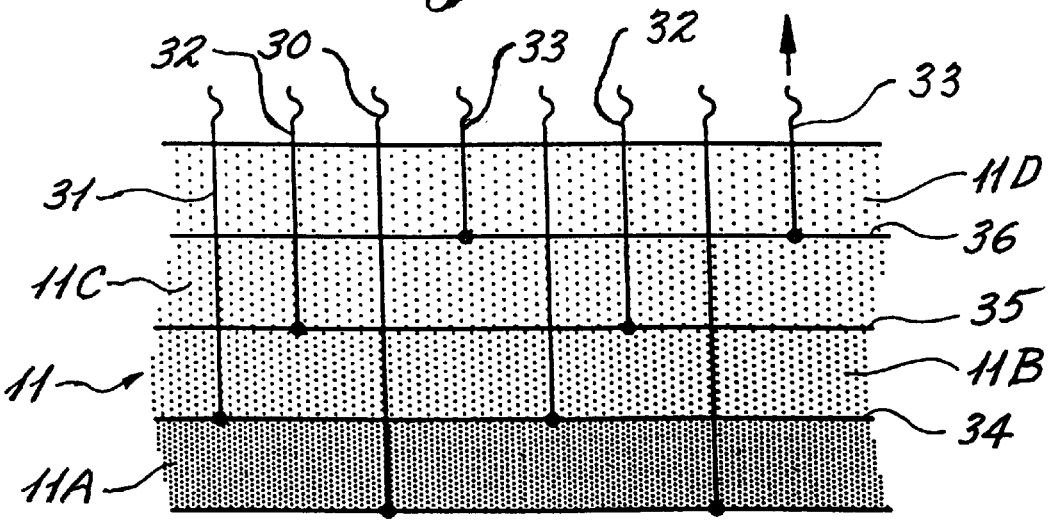
FIG. 4 is a partial front plan view of one embodiment of sectioned screen utilized with the structures of the invention.

With particular reference to FIG. 4, the details of one screen, net or mesh structure in accordance with the invention are shown in detail. The screen 11 includes a plurality of separate vertically spaced sections 11A, 11B, 11C and 11D which extend upwardly from the bottom edge 14 to the upper edge 12. Section 11A is constructed of a fine mesh material defining openings of approximately ⅛" therethrough while the mesh of section 11B defines openings of a larger size such as ¼". Section 11C is formed of a more open mesh having larger openings in the order of ½" and the least dense upper screen section 11D has the largest openings of ¾" or greater. The screen sections are preferably horizontally connected using sturdy longitudinal cords or cables 34–36 which are secured at their ends to vertical cables as previously described.

The lower sections of the screens are designed to trap finer particles and to reduce the pass-through fluid velocity of winds, currents and/or tidal waters to facilitate solid deposits along the bottom of the screens. The mesh materials are also preferably formed of a material exhibiting at least a 200 lb. Test.

Figure 5:
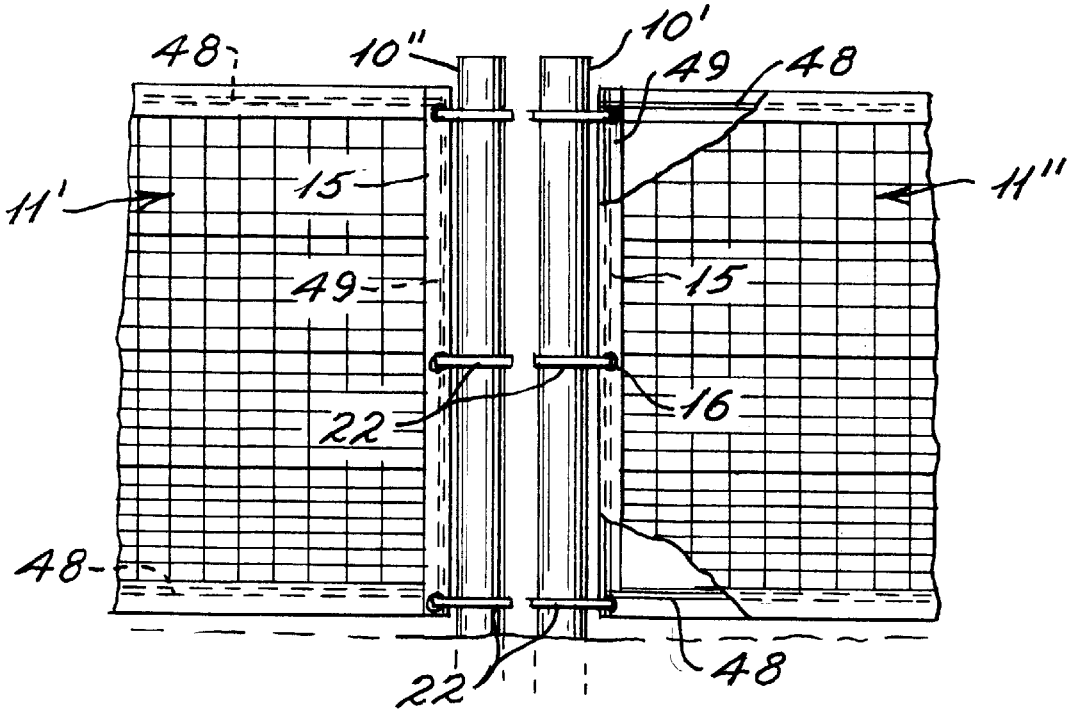
FIG. 5 is an enlarged side illustrational view showing two adjacent stanchions for securing screens thereto in end-to-end relationship and showing the screens being secured to the stanchions utilizing one or more guide rings.

As previously noted, the upper portion of the screen material is securely attached to at least two end stanchions 10' and 10" by vertically adjustable members such as the rings 22 as shown in FIG. 5. C-ring clamps 13, see FIG. 3B, conventionally used with chain link fence structures, or other clamps, may be used to secure the screens to the stanchions. The clamps may be mounted about the posts or stanchions and through the mesh material of each screen and are secured by connecting the outer spaced flanges 17 thereof by nut and bolt fasteners 18 and 19.

The screens or netting materials 11 made also be weaved between the intermediate stanchions 10 which are spaced between the end stanchions 10' and 10". Therefore, as shown in FIGS. 1 and 2, the screening material passes behind the first intermediate stanchion 10 spaced from the innermost end stanchions 10' and then forwardly of the second intermediate stanchion out from the innermost stanchion 10' so that the screen or netting material passes in front and then behind adjacent stanchions or posts. This type of mounting arrangement will more firmly secure the screen or mesh material without requiring the use of additional fastening elements so that the material will not be displaced by wind, tidal or wave action. However, in some embodiments, the screen or screens may be secured to the intermediate stanchions 10 without being weaved therebetween.

Figures 6A, 6B, 6C:
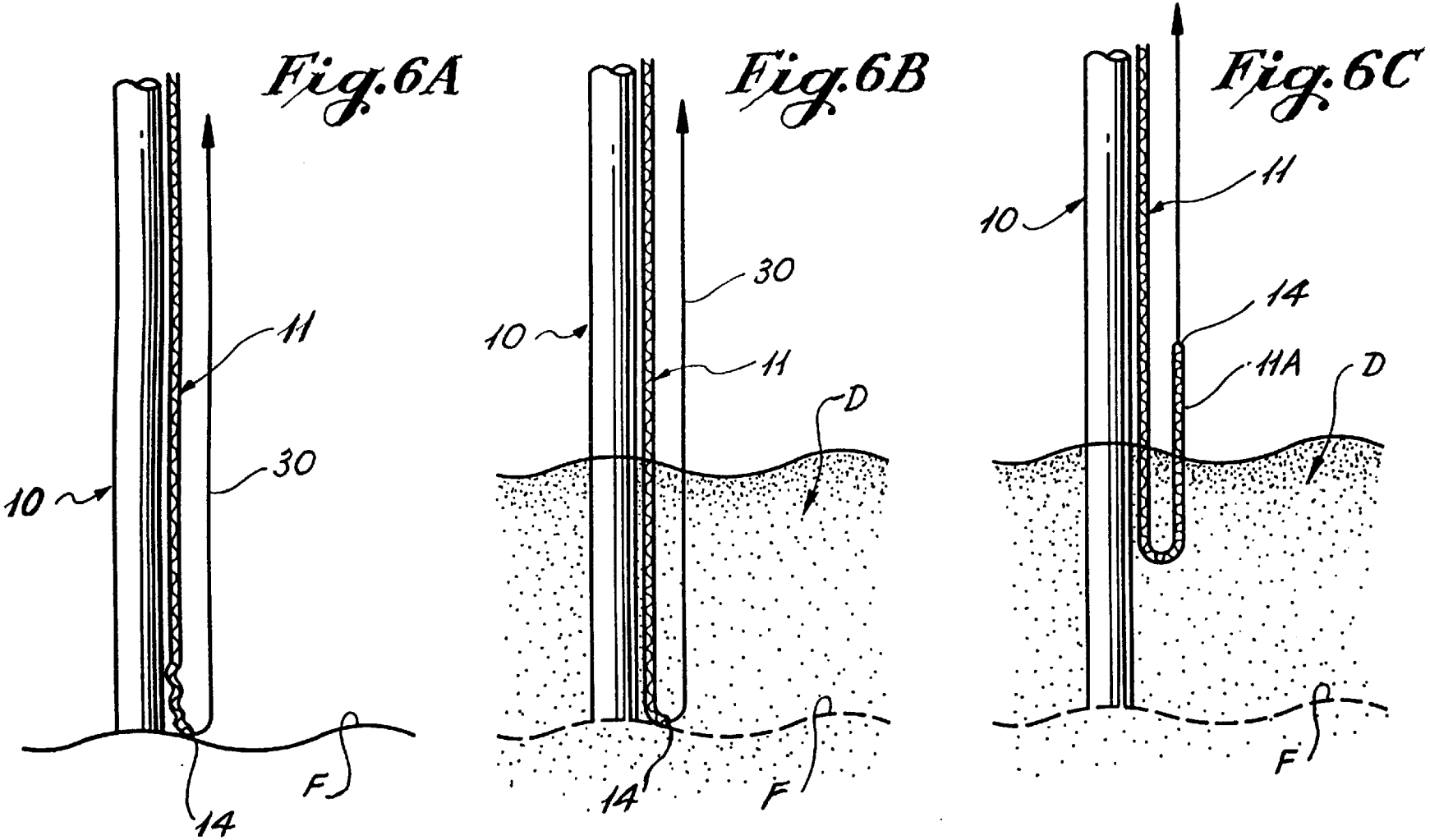
FIGS. 6A–6C show one embodiment for periodically elevating the lower portion of the screens of the invention as materials are deposited and illustrating the manner in which the lower portions of the screens are retained by the newly deposited material in FIG. 6C.

The lower portion of each screen is designed to rest along a land mass to be reclaimed, such as along the beach and the floor "F" of a body of water "W", as shown in FIG. 1, when initially deployed. The screens or netting material should be pulled taut before being secured to the stanchions during deployment and the longitudinal cables or wire rope extending along the length of each screen, when flexible netting is used, will resist lateral movement of the screen relative to a line of deployment of a groyne. As sand, gravel, shells, rocks and other solid materials become trapped along the lower portions of a screen, at least the lower edges 14 thereof will be periodically raised. It is preferred to periodically elevate at least the lower portion 14 of the screening material so as to limit disturbance of newly deposited materials during the reclamation process. With specific reference to FIG. 6A, the lower edge of a screen 11 is initially deployed in contact with the floor "F" of the body of water "W". After material deposits begin to build, as shown in FIG. 6B, to a height, for example, of approximately 2 to 3 feet, the lower edge 14 of the screen is raised utilizing draw or lift cords, chains, cables and the like so that the lower edge is raised above the material deposit "D" with an intermediate portion of the screen being buried approximately a foot within the deposit, as shown in FIG. 6C. The screen is periodically raised so as to not adversely interfere with the buildup of deposits while the deposits function to retain the lowest deployed portion of the screen in position as new deposits are being formed.

Figure 7:
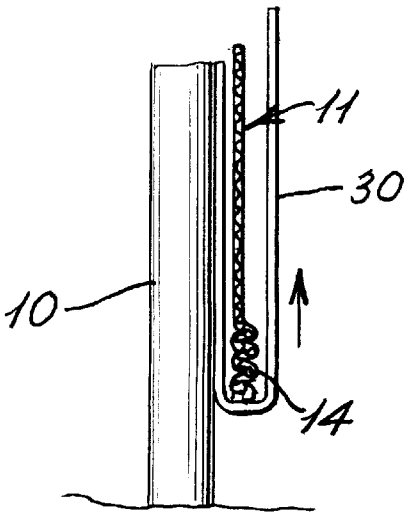
FIG. 7 discloses an alternate embodiment for elevating the lower portion of a screen of the present invention.

It is contemplated that the screens may be raised in other ways. With respect to FIG. 7, the screens may also be raised in an accordion-type fashion by a plurality of lift ropes, cords, cables or lines 30 which are associated with or provided adjacent some or all of the posts or stanchions. The lines 30 extend down and around the bottom edge 14 of the screen or mesh material and back to the upper portion of the screen adjacent the stanchions where the lines are either tied to the stanchions or to the mesh material of the screen. A separate clamp may be utilized for purposes of securing the ends of the lifting lines. In this embodiment, when it is desired to elevate the lower portion of the mesh material, the line is elevated, thereby lifting the screen or net from the lower edge upwardly. As with the embodiment shown in FIGS. 6A–6C, it may be preferred to raise the lower edge after deposits are formed only to a height which will ensure that a portion of the screen is retained within the deposited material.

As shown in FIG. 5, in some embodiments, it is preferred that one or more lifting ropes, cords, cables or lines 30 be associated with each stanchion 10' and 10" which lines are connected to or about one or more of the ring members 22. In some cases, the use of two lines for each stanchion will prevent the rings from binding against the stanchions when elevated or raised. However, a single line may also be used.

To further facilitate the elevating of the screens or mesh material during the reclamation process, intermediate lifting ropes or lines 31–33 may be provided which are secured to the cables 34–36 which extend between the sections of the screening material, as shown in FIG. 1. Although a single intermediate lifting rope or line may be used between each of the stanchions, additional, supplemental or intermediate lifting lines or ropes may be used. In the use of these lines, when it is necessary, the lines are untied from the upper edge 12 of the screen or mesh material and thereafter elevated to raise the screening material as previously discussed. Thereafter, the lines are re-tied to the upper edge 12 of the screen or mesh material, thereby holding the lower sections of the screen in the newly deployed position.

During use, the groyne structures will be spaced at various intervals relative to one another along areas where land is to be reclaimed such as a given area of beachfront or shoreline.

The exact spacing will be determined by the wind, wave and tidal action as well as the contour of the land in the area which is to be reclaimed. Once material deposits have elevated to a predetermined height, the screens and, in some instances, the posts or stanchions, are removed to allow natural buildup of additional deposits.

Figure 8:
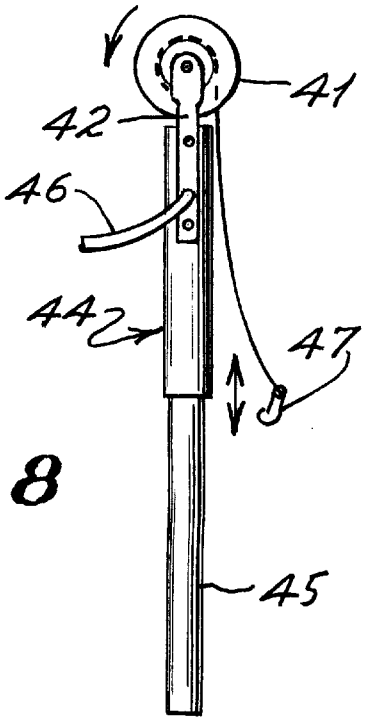
FIG. 8 is a side elevational view of a device which may be utilized with the present invention to elevate the screens and including a hook for engaging rings or sleeves which mount the screens to the stanchions.

With particular reference to FIG. 8, to facilitate raising of a screen, one or more portable lifting devices may be used. Each device includes a take-up reel 41 to which a lift line may be attached. The line may include a hook or fastener 47 for engaging a ring or sleeve. Each reel 41 is mounted by a bracket 42 to a support member 44. In some embodiments, the support member may be formed as a hollow pipe which is of a size to be seated over the upper end of a respective stanchion or post. In other embodiments, the support member may be a manually engageable handle or an extendible assembly including an extension 45 which can be used to support the lifting device from the sea floor. Further, although the reel may be manually operated, a pneumatic or hydraulic line 46 could be connected between a suitable fluid control source and a drive motor (not shown) for purposes of powering the take-up reel.

Figure 9:
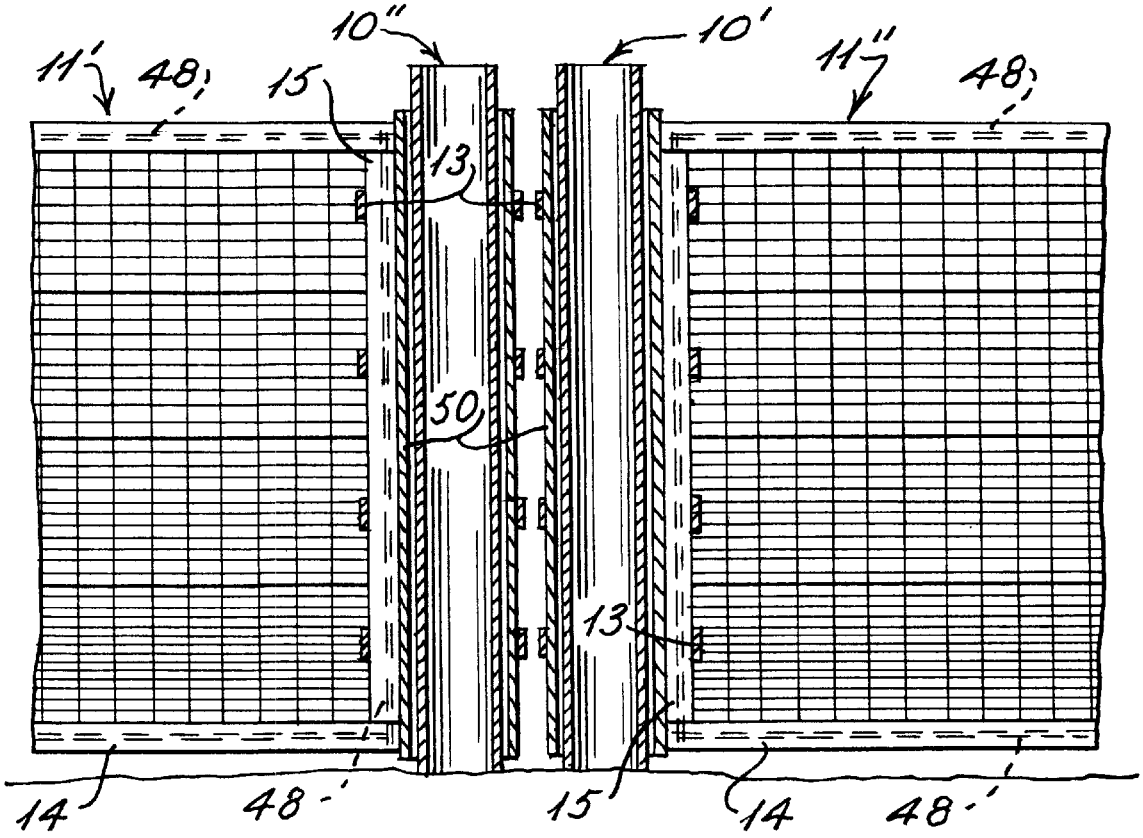
FIG. 9 is a side illustrational view of a further embodiment of the invention showing screens mounted to sleeves movable with respect to spaced stanchions.

Due to the tremendous forces which are encountered by groynes which are erected along shorelines, screens or netting material often can be ripped from mounting engagement with the stanchions. In an effort to provide for increased durability and facilitate the periodic elevation of the screens of the present invention, as opposed to ring elements for securing the screens to the stanchions, the present invention utilizes elongated sleeves to secure the ends of the screens to the stanchions as shown in FIGS. 9–12. As shown in FIG. 9, elongated tubes or sleeves 50 of a size to be slidingly received about the stanchions 10' and 10" are used to secure the ends 15 of the screens 11' and 11" to the stanchions. To further reinforce the screens, the ends, and upper and lower edges may include reinforcing cables or wire ropes 49 and 48, respectively, secured within a selvage or hem structure as previously described. The screens are secured to the sleeves 50 by way of metal band clamps 13 which may be similar to those shown in FIG. 3B. Preferably, the longitudinal cables should be taut when the screens are deployed. As previously described, the longitudinal cables 48 are secured by appropriate fasteners to the vertical cables 49. The clamps engage the vertical cables and place a tensioning force on the longitudinal cables. When it becomes necessary to raise the lower portions 14 of each of the screens due to the deposit of materials along the lower edge of the screens, lifting devices may be secured to elevate the sleeves 50 and thereby raise the screens relative to the stanchions.

Figure 11:
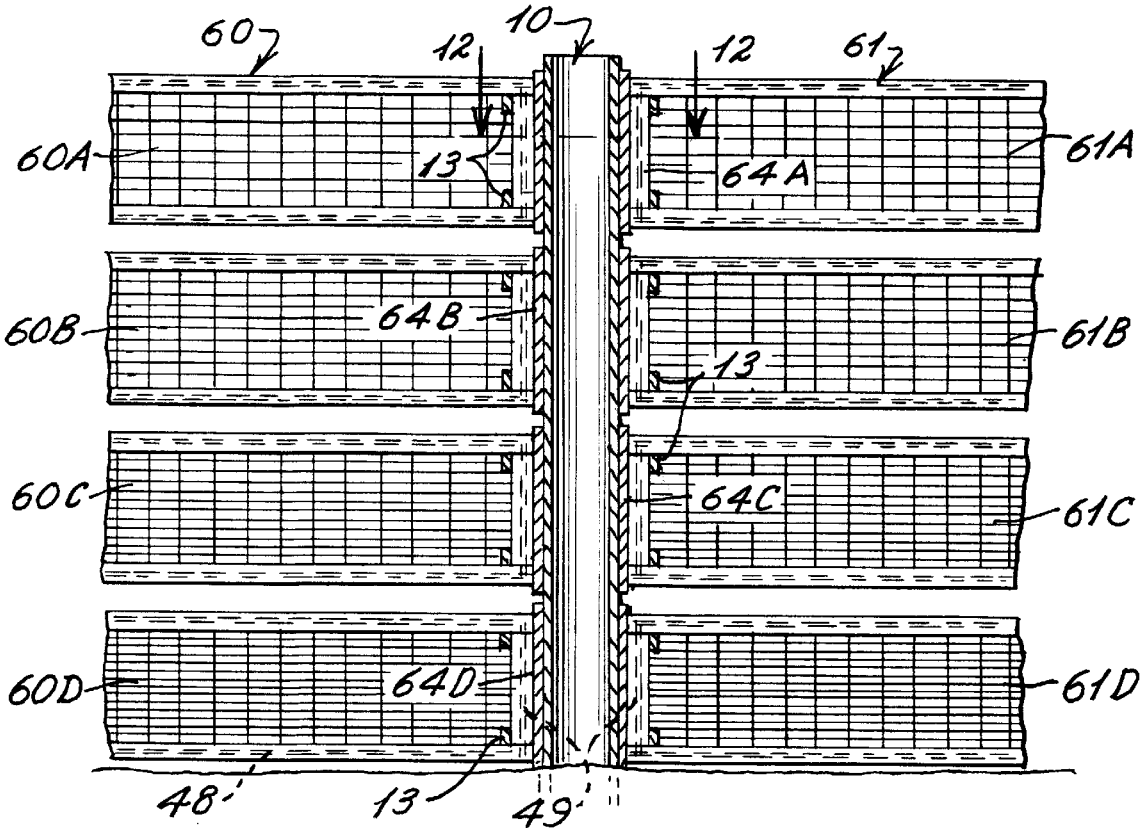
FIG. 11 is a view similar to FIG. 10 showing the screen sections mounted to a common stanchion.
Figure 12:
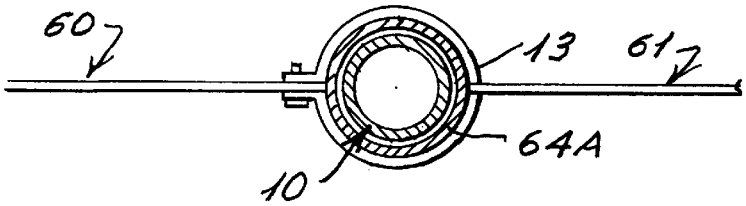
FIG. 12 is a cross-section taken along line 12—12 of FIG. 11.

As shown in FIG. 9, in some embodiments, each screen is connected at its ends to separate pairs of stanchions 10' and 10" as described with respect to some of the previous embodiments. However, in some instances, and as shown in FIG. 11, adjacent screens may be mounted to a common stanchion, such as shown at 10. It should also be noted that, as opposed to separate screen 11, 11' and 11", a single screen may be provided extending between each of the stanchions, such as shown in FIG. 1.

Figure 10:
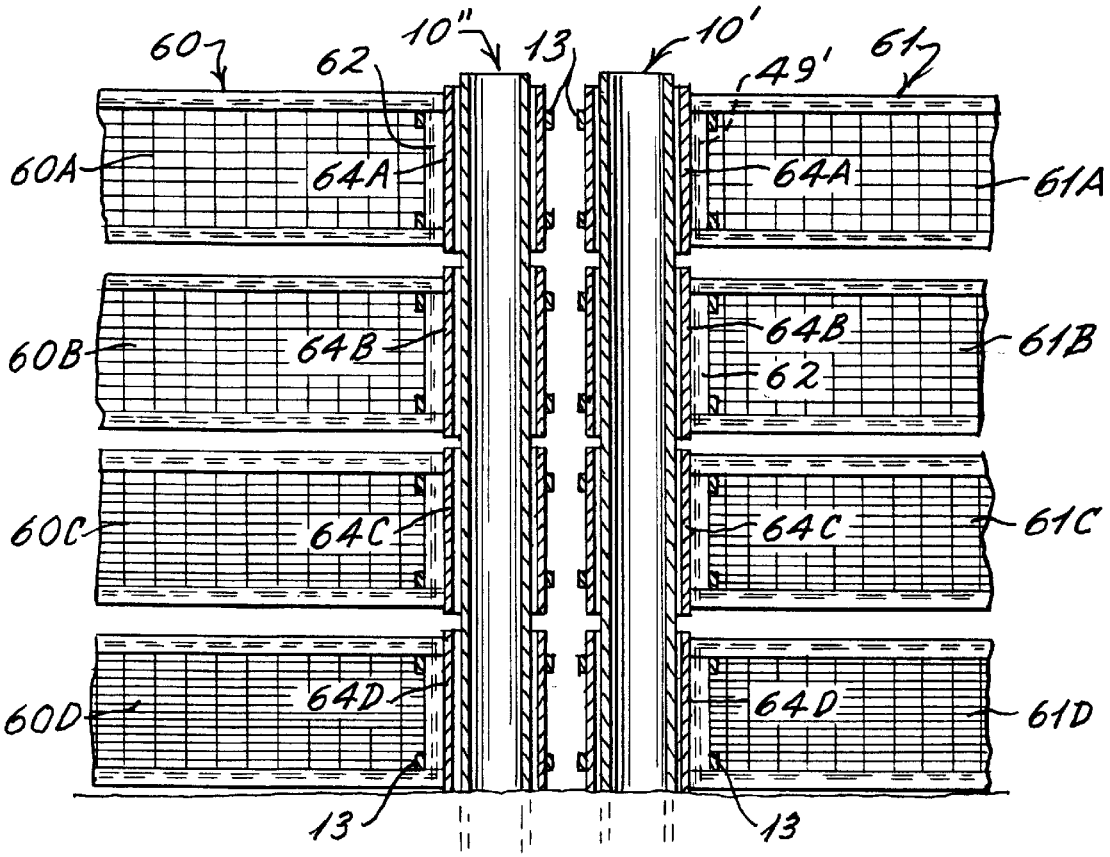
FIG. 10 is a view similar to FIG. 9 showing an alternate screen structure with independently movable screen sections.

To further facilitate the manner in which the screens of the present invention may be elevated relative to the stanchions, the screens may be structured as independently movable sections each of which may include top, bottom and side reinforcements, such as by way of cables 48' and 49'. As shown in FIG. 10, screens 60 and 61 have end portions 62 which are secured to spaced end stanchions 10' and 10" by a plurality of clamps, such as shown at 13 in FIG. 3B, which engage the vertical end cables 49' and thereby pull the longitudinal cables 48' taut. In this embodiment, each of the screens includes a plurality of separately movable sections 60A, 61A, 60B, 61B, 60C, 61C, 60D and 61D. In order that the separate sections of the screens can be independently moved with respect to one another, each screen section is secured to a separate sleeve as shown at 64A, 64B, 64C and 64D. The ends of each screen are reinforced by cables 49' which will facilitate the manner in which the clamps 13 retain the end portions of the screens relative to the movable sleeves.

With the embodiment of FIG. 10, each of the separate sections may be independently elevated such that when the uppermost screen is no longer required, it may simply be removed from the stanchions 10' or 10" and stored.

With the present invention, the screen sections may be formed with varying sizes of mesh as previously described and as shown with respect to the embodiment of FIG. 4 such that the openings in the lower screens 60D and 61D are smaller than those of the remaining screens.

A further variation of the present invention is shown in FIG. 11 wherein the screens 60 and 61 are shown as being mounted to a common stanchion 10 as opposed to two spaced and adjacent stanchions 10' and 10". In this embodiment, adjacent screen sections must be raised together. Intermediate portions of a screen may also be secured to sleeves by appropriate clamps.

Figure 13:
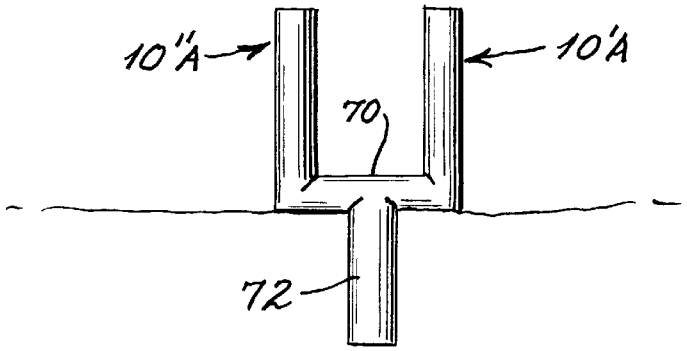
FIG. 13 is a front elevational view, on a reduced scale, of a modified stanchion accordance with the invention.

With reference to FIG. 13, the end stanchions 10" and 10' may be formed as a single structural componentin a configuration of a "Y" having a common base or standard 72. The standard is connected by a cross arm 70 to the vertical stanchion posts 10"A and 10'A. In this respect, the stanchions or posts will still be spaced relative to one another within the meaning of the invention and the attached claims, and such a "Y" structure permits independent adjustment of adjacent screens mounted thereto.

The present invention facilitates the reclamation of land masses, shoreline and offshore areas without adversely affecting the environment, land or aquatic life. As shown in FIG. 2, when necessary, such as to prevent interference with aquatic life relative to beach areas such as the movement of turtles along the shore to lay eggs, the screen(s) of the system may be raised and secured. After the egg laying seasons is over, the screen(s) may be readily re-deployed.

In use, the length of each groyne-like structure, the number of stanchions and the number of screens may be varied. The spacing between each groyne need not be in parallel relationship. Deployment angles, densities and size of structures will depend upon various conditions, such as wind conditions and tidal and wave action.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A method of reclaiming land by causing the deposit and retention of particulate material utilizing a plurality of spaced groynes, each groyne including a plurality of spaced stanchions which support at least one screen having upper and lower portions and end edges each of which is reinforced with a longitudinal reinforcement and with reinforcements for the upper and lower portions being connected to reinforcements for the end edges, and the at least one screen being elevatable with respect to material being deposited and wherein the at least one screen is formed having a plurality of openings therethrough through which a fluid will flow and cause the particulate material to deposit but which are of the size to prohibit passage of larger solid material conveyed in fluid currents including the steps of:

a) placing the stanchions in spaced relationship relative to one another;

b) mounting the at least one screen to the spaced stanchions by securing at least the reinforced end edges on spaced end stanchions and pulling the longitudinal reinforcements taut so that the lower portion thereof is adjacent existing solid material to thereby create a buildup of newly deposited solid materials adjacent the lower portions thereof; and c) preserving the buildup of newly deposited solid materials by periodically elevating at least the lower portion of the at least one screen so that the lower portion thereof is maintained substantially at the height of newly deposited solid materials.

2. The method of claim 1 including mounting the end edges of the at least one each screen to supporting elements which are vertically moveable along said end stanchions.

3. The method of claim 2 including mounting a plurality of screens to a plurality of separate end stanchions and elevating each of the screens independently of one another.

4. The method of claim 1 including mounting at least one sleeve member to each of the end stanchions so as to be movable with respect thereto, and mounting the end edges of the at least one screen to the sleeve members.

5. The method of claim 4 including mounting a plurality of screens to the stanchions and elevating each of the screens independently of one another.

6. The method of claim 4 in which said at least one screen includes a plurality of independently adjustable vertically arranged sections, mounting a plurality of sleeve members to each of said end stanchions, mounting said plurality of sections to said plurality of sleeve members, and removing an uppermost one of said plurality of sections from said end stanchions as said screen is periodically elevated.

7. A porous groyne for land reclamation including:

a plurality of stanchions including at least one pair of spaced end stanchions, at least one screen, said at least screen having an upper portion, a lower portion and opposite ends and having a plurality of openings therein through which fluid and some fluid conveyed solids may pass, reinforcing structures extending longitudinally with respect to said upper and lower portions and connected to reinforcing portions extending along said ends, supports for vertically adjustably supporting said opposite ends of each of said screen to said at least one pair of end stanchions such that said longitudinal reinforcing structures are taut, and elevating elements for periodically elevating said at least one screen relative to said pair of end stanchions.

8. The porous groyne of claim 7 including at least one intermediate stanchion positioned between said at least one pair of end stanchions to which one of said at least one screen may be selectively secured.

9. The porous groyne of claim 7 in which said supports for supporting said at least one screen includes a plurality of ring members disposed about each of said end stanchions.

10. The porous groyne of claim 7 in which said supports for supporting said at least one screen include at least one sleeve mounted to each of said end stanchions, securing elements for securing said end portions of said at least one screen to said sleeves whereby said at least one screen is guided relative to said pair of spaced end stanchions by said sleeves as said at least one screen is periodically elevated.

11. The porous groyne of claim 10 wherein said at least one screen includes a plurality of independently moveable vertically arranged sections, and a plurality of sleeves mounted to each end stanchion to which said plurality of screen sections are secured.

12. The porous groyne of claim 11 wherein a lower of said vertically arranged screen sections includes openings of a first dimension therein, said first dimension being smaller than a dimension of openings in said screen sections spaced vertically above to said lower section.

13. A method of reclaiming land by causing the deposit and retention of particulate material utilizing a plurality of spaced groynes, each groyne including a plurality of spaced stanchions which support a plurality of screens having upper and lower portions and end edges, and the screens being elevatable with respect to material being deposited and wherein the screens are formed having a plurality of openings therethrough through which a fluid will flow and cause the particulate material to deposit but which are of the size to prohibit passage of larger solid material conveyed in fluid currents including the steps of:

a) placing the stanchions in spaced relationship relative to one another;

b) mounting the screen to the spaced stanchions by supporting at least the end edges of each screen on spaced end stanchions which do not support other of the screens and so that the lower portions thereof are adjacent existing solid material to thereby create a buildup of newly deposited solid materials adjacent the lower portions thereof; and c) preserving the buildup of newly deposited solid materials by periodically elevating at least the lower portions of the screens so that the lower portions thereof are maintained substantially at the height of newly deposited solid materials.

14. The method of claim 13 including securing the end edges of each screen to members which are vertically moveable along said end stanchions.

15. The method of claim 13 including mounting at least one sleeve member to each of the end stanchions so as to be movable with respect thereto, and securing the end edges of each screen to the sleeve members.

16. The method of claim 15 including independently elevating each of the screens independently of one another.

17. The method of claim 15 in which each of said screens includes a plurality of independently adjustable vertically arranged sections including mounting a plurality of sleeve members to each of said end stanchions, securing said plurality of sections to said plurality of sleeve members, and removing an uppermost one of said plurality of sections from said stanchions as said screens are periodically elevated.

18. A porous groyne for land reclamation including:

a plurality of pairs of spaced end stanchions, a plurality of screens, each of said screens having an upper portion, a lower portion and opposite ends and having a plurality of openings therein through which fluid and some fluid conveyed solids may pass, supports for vertically adjustably supporting said opposite ends of each of said screens relative to spaced pairs of said end stanchions such that said screens are vertically adjustable independently of one another, and elevating elements for periodically elevating at least said lower portion of each of said screens relative to said pairs of end stanchions.

19. The porous groyne of claim 18 in which said supports for supporting said screens include a plurality of ring members disposed about each of said end stanchions.

20. The porous groyne of claim 18 in which said supports for supporting said screens include at least one sleeve mounted to each of said end stanchions, securing element for securing said end portions of said screens to said at least one sleeve whereby said screens are guided relative to said pairs of spaced end stanchions by said sleeves as said screens are periodically elevated.

21. The porous groyne of claim 20 wherein said screens include a plurality of independently moveable vertically arranged sections, and a plurality of sleeves mounted to each end stanchion to which said plurality of screen sections are secured.

22. The porous groyne of claim 21 wherein a lower of said vertically arranged screen sections includes openings of a first dimension therein, said first dimension being smaller than a dimension of openings in said screen sections spaced vertically above to said lower section.

23. The porous groyne structure of claim 18 wherein at least one of said pair of end stanchions are connected at a common base.

* * * * *

UNITED STATES PATENT AND TRADEMARK OFFICE

CERTIFICATE OF CORRECTION

PATENT NO. : 6,481,926 B2
APPLICATION NO. : 09/828241
DATED : November 19, 2002
INVENTOR(S) : Benedict et al.

It is certified that error appears in the above-identified patent and that said Letters Patent is hereby corrected as shown below:

On the title page item (75), line 2, inventor's name listed as "A. Yates Christian" should be corrected to read: --Christian A. Yates--

Signed and Sealed this

Fifteenth Day of January, 2008

JON W. DUDAS
*Director of the United States Patent and Trademark Office*